US006395698B1

(12) United States Patent
Daun et al.

(10) Patent No.: US 6,395,698 B1
(45) Date of Patent: May 28, 2002

(54) CORROSION RESISTANT SANITIZING/ DISINFECTING CLEANING AND WOOD PRESERVATIVE FORMULATION

(75) Inventors: Dennis Daun, Round Lake, IL (US); James O. Burlew, Topeka, KS (US); Robert H. DeWolf, Carpentersville, IL (US)

(73) Assignee: Mason Chemical Company, Arlington Heights, IL (US)

( * ) Notice: Subject to any disclaimer, the term of this patent is extended or adjusted under 35 U.S.C. 154(b) by 0 days.

(21) Appl. No.: 09/878,899

(22) Filed: Jun. 11, 2001

(51) Int. Cl.[7] ..... C11D 1/62; C11D 1/835; C11D 3/43

(52) U.S. Cl. ..... 510/384; 510/238; 510/237; 510/362; 510/384; 510/413; 510/421; 510/480; 510/504; 510/436; 510/319; 510/391; 510/356; 510/477

(58) Field of Search ..... 510/238, 237, 510/362, 384, 413, 421, 480, 504, 436, 319, 391, 356, 477

(56) References Cited

U.S. PATENT DOCUMENTS 4,302,364 A * 11/1981 Gosset et al. ..... 252/545
5,030,659 A * 7/1991 Bansemir et al. ..... 514/635
5,124,359 A * 6/1992 Wachman et al. ..... 514/642
5,547,990 A * 8/1996 Hall et al. ..... 514/563
5,728,667 A * 3/1998 Richter ..... 510/235
5,739,168 A * 4/1998 Hioki et al. ..... 514/643
5,798,329 A * 8/1998 Taylor et al. ..... 510/384
6,159,916 A * 12/2000 Robbins et al. ..... 510/238
6,245,361 B1 * 6/2001 Merritt ..... 424/665

FOREIGN PATENT DOCUMENTS

| | | | |
|---|---|---|---|
| EP | 185970 | * | 7/1986 |
| EP | 827691 | * | 3/1998 |
| FR | 2695297 | * | 3/1994 |

* cited by examiner

*Primary Examiner*—Charles Boyer
(74) *Attorney, Agent, or Firm*—R. William Graham

(57) ABSTRACT

A corrosion inhibiting, sanitizing/disinfecting, wood preserving and hard surface cleaning formulation comprising: a quaternary ammonium halide; and a sequestrant in a sufficient amount to sequester the halide ion without eliminating the quaternary ammonium ion's sanitizing/disinfecting capability, wood preserving characteristics, and hard surface cleaning ability.

21 Claims, No Drawings

CORROSION RESISTANT SANITIZING/ DISINFECTING CLEANING AND WOOD PRESERVATIVE FORMULATION

BACKGROUND OF THE INVENTION

1. Field of the Invention

The present invention relates to a disinfectant and hard surface cleaning formulation which exhibits improved rust inhibiting properties. More particularly, the invention relates to a quaternary ammonium formulation for use in disinfecting metal surfaces and which prevents or inhibits rust formation on such metal surfaces.

2. Related Art

Public health has been a long time concern of both the public and private sectors. Recently, increased concern has emerged regarding whether public health products used to kill microorganisms pathogenic to man on inanimate surfaces and objects in hospital, schools, restaurants, and homes work as claimed on the label. The private and public sector communities, including competitor registrants, have made the Environmental Protection Agency (EPA) aware of sterilizers and hospital disinfectants which may be ineffective.

In partial solution to this problem, disinfecting solutions of quaternaries can be used as hard surface disinfectants, sanitizers, fungicides, virucides, germicides, germistats, bactericides, bacteriostats , as well as mold and mildew control agents. Also, quaternaries can be used as slimicides for use in the manufacture of paper and paperboard that contact food, algaecides for use in pools and/or recirculating water cooling towers, and incorporated into wood preservatives. Quaternaries have a number of other related uses due to their broad spectrum, efficacy, and physical/chemical properties. They also enhance the cleaning ability of detergent formulations.

The use of quaternary ammonium compounds, in conjunction with a nonionic surfactant to provide sanitizing, disinfecting and germicidal formulations, have been described in several United States patents including U.S. Pat. No. 3,539,520, issued to Canto et al., teaching certain detergent/sanitizing formulations which are based on aqueous mixtures of quaternary ammonium compounds, acting as the germicidal agent, in conjunction with nonionic surfactants such as alkoxy block copolymers. U.S. Pat. No. 6,143,710 issued to Lu et al. discloses disinfecting and cleaning composition in concentrated form comprising a quaternary ammonium compound, a nonionic surfactant and a mitigating compound selected from ethoxycellulose, polyalkylene glycol, alkylamidopropylbetains and alkylpolyalkoxylates among other conventional additives. U.S. Pat. No. 5,454,984 issue to Graubart et al. discloses quaternary ammonium compounds as germicidal active agents in conjunction with nonionic surfactants.

Though quaternaries have several beneficial aspects, they have several negative ones as well. For instance, quaternaries are difficult to use in formulations since they lack compatibility with many compounds. For instance, anionics neutralize quaternaries and may precipitate them as insolubles, thereby rendering them ineffective. Another problem with quaternary solutions is the severe rusting and corrosion that they cause due to the dissociation of chloride from the quaternary compound which reacts with polar water to take on the characteristics of hydrochloric acid.

Corrosion is a particular disadvantage when using quaternary ammonium compounds with metal machinery and equipment. There is the need to include a corrosion inhibitor in the formulation to suppress the corrosion of the ferrous metal promoted by the quaternary ammonium formulation. Corrosion inhibitors such as polycarboxylic acids and phosphate esters may prove to be only moderately effective in reducing rust while adding unwanted cost to the process. Accordingly, there is a need in the industry for a formulation which prevents the above mentioned problems without exhibiting deleterious effects on the metal which comes in contact with the formulation.

A quaternary formulation for use in a sanitizing/disinfecting solution disclosed in the present invention utilizes cationic compounds which are compatible with quaternaries and provide corrosion inhibiting properties to ferrous metal surfaces. The quaternary formulation of the present invention also includes a non-ionic surfactant to increase the surface cleaning action. Furthermore, the formulation of the present invention is known to be safe when used as directed.

SUMMARY OF THE INVENTION

It is an object of the present invention to provide a quaternary disinfecting/sanitizing solution which inhibits the corrosion of ferrous metal surfaces and a method for using the formulation.

Accordingly, the present invention is directed to a disinfecting/sanitizing and hard surface cleaning formulation which exhibits corrosion inhibiting properties. The formulation, in addition to a blend of quaternary ammonium chlorides, includes a blend of a cationic solvent, a non-ionic surfactant, a sequestrant, and a diluent.

In accordance with the present invention, certain quaternary ammonium formulations have been found to be particularly effective to prevent the transfer of plant diseases from field to field and orchard to orchard when the equipment and machinery used in the fields and orchards are coated with the present formulation. Furthermore, it has been found that the present formulation, when applied to the equipment and machinery, unexpectedly eliminates or reduces the corrosion of the metal equipment and machinery used in the fields and orchards.

The quaternary ammonium formulation of the present invention comprises a mixture of n-alkyl dimethyl benzyl ammonium chloride, octyl decyl dimethyl ammonium chloride, dioctyl dimethyl ammonium chloride and didecyl dimethyl ammonium chloride; an alkanolamine diluent; an organophosphonic acid sequestrant; an ethoxylated long chain alcohol; and water (Tap). These formulations include highly active, broad spectrum quaternaries which are extremely effective in hard water up to about 400 ppm hardness (calculated as $CaCO_3$) in the presence of about 5% contamination. The quaternary ammonium formulation is particularly effective as a disinfectant; cleaner; mildewstat; sanitizer (for non-food contact surfaces); deodorizer for hospitals, institutions, industrial and school use; and for harvesting, handling, storage, and transportation equipment.

DETAILED DESCRIPTION

The present invention described herein sets forth a unique formulation to clean various surfaces (including, but not limited to, non-food contact glass, metal, stainless steel, glazed porcelain, glazed ceramics, fiberglass, granite, marble, plastic, chrome, vinyl, tables, chairs, desks, bed frames, walls, cabinets, doorknobs, garbage cans, picnic tables, outdoor furniture, telephones, non-food contact counter tops, sinks refrigerator, exteriors, coolers, freezer exteriors, stove tops, appliances, non-food contact equipment, shelves, racks, carts, highchairs, shower stalls, shower doors and curtains, tubs and tiles, toilets, urinals, porcelain glazed tile and restroom fixtures, kennels and cages, windows and mirrors) in a number of different environments (including, but not limited to, hospitals, nursing homes, medical and dental offices and clinics, operating rooms, isolation wards, medical research facilities, day care centers and nurseries, restaurants and bars, cafeterias, institutional kitchens, fast food operations and food storage areas, supermarkets, convenience stores, retail and whole sale establishments, dressing rooms and laundries, crime scenes and funeral homes, institutional facilities, laboratories, factories, business and office buildings, restrooms, hotels and motels and transportation terminals, kitchens, bathrooms and other household areas, institutions, schools and colleges, churches, classrooms, athletic facilities and locker rooms, camp grounds, play grounds, and recreational facilities, food processing plants, dairy farms hog farms, poultry and turkey farms and egg processing plants, veterinary clinics, animal life science laboratories, kennels, breeding and grooming establishments, pet animal quarters, zoos, pet shops, and other animal care facilities, household and automotive garages, boats, ships, campers, trailers, mobile homes, cars, buses, trains, taxis, and airplanes). In particular, the present formulation is useful in preventing the transfer of plant disease from field to field and orchard to orchard by coating the formulation onto the equipment and machinery used in the fields and orchards. The present invention is also useful as a wood preservative. In addition to its other uses, the present formulation unexpectedly eliminates or reduces the corrosion of the metal equipment and machinery, particularly, ferrous metal which is highly susceptible to rust and corrosion.

The formulation is made from a blend including a quaternary disinfectant, a cationic solvent, a non-ionic surfactant, a sequestrant, and a diluent. In a preferred embodiment, the formulation is made from a mixture of quaternary ammonium chlorides, an organophosphoric acid, an alkanolamine, an ethoxylated long chain alcohol, and water.

Quaternary ammonium compounds (quats) were first synthesized in 1930's when a long chain aliphatic hydrocarbon was attached to a quaternary nitrogen atom. These first molecules have progressed to the many generations of quats known today. In general, quats are a type of organic compound in which the molecular structure includes a central nitrogen atom joined to four organic groups to provide a cationic site, and a negatively charged acid radical to form a anionic site. Generally the structure of a quat is illustrated by the formula I:

I

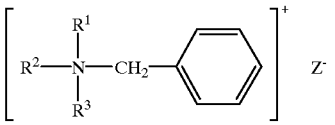

where $R^1$, $R^2$, $R^3$ and $R^4$ are the same or different and represent a hydrocarbon having from 1 to about 18 carbon atoms. Z is a negatively charged ion, e.g., a halide such as fluoride, chloride, bromide, iodide or the like.

The "first generation" of quats were the Alkyl Dimethyl Benzyl Ammonium Chlorides or ADBAC for short. The most popular of the first generation quats is illustrated by the formula II:

II

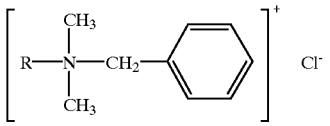

where the R is a combination of long chain alkyl groups which includes about 50% $C_{14}$, about 40% $C_{12}$ and about 10% $C_{16}$. In another popular version of ADBAC quat, R is about 5% $C_{12}$, about 60% $C_{14}$, about 30% $C_{16}$ and about 5% $C_{18}$. As a result of numerous experiments on the ADBAC series of quats, it has been found that biocidal activity peaks at a carbon chain length of about $C_{14}$.

The development of ADBAC quats was a significant discovery in fighting diseases. However, such quats do have one slight disadvantage where it was observed that the quats were adversely affected by hard water. More specifically, it was found that positively charged calcium and magnesium ions present in hard water compete with the quat for the negatively charged bonding sites on the bacteria. Typically, this effect can be reduced with the addition of a chelating agent which bonds to the calcium and magnesium ions, leaving the reactive sites on the microorganism free to complex with the quat.

Other attempts to increase the efficacy and hard water tolerance of the ADBAC quats were carried out by substituting an ethyl group for a hydrogen on the aromatic ring which resulted in the formation of Alkyl dimethyl ethylbenzyl ammonium chloride or EBC quat, which had a distribution of about 50% $C_{12}$, about 30% $C_{14}$, about 17% $C_{16}$ and about 3% $C_{18}$. This quat was subsequently replaced with the more popular version which has a distribution of about 68% $C_{12}$ and 32% $C_{14}$. However, Ethyl benzyl chloride is approximately three times more expensive that Benzyl chloride, and the improved performance of the EBC quat over the ADBAC quats did not outweigh the additional cost of the Ethyl benzyl chloride starting material. Therefore, The EBC quats never really made it to the market as straight products.

A third generation of quats was developed as a blend of ADBAC and EBC quats. This blend, which is typically a 50/50 blend has improved biological efficacy, better detergency and a relatively lower level of toxicity.

The development of catalytic amination of long chain alcohols in 1965 made the production of dialkylmethyl amines (DAMA) available. These DAMA's could be quaternarized with methyl chloride to give dialkyl dimethyl ammonium chloride which display outstanding germicidal performance and improved water tolerance; However, these quats are not very water soluble, especially the didecyl type. They are also more expensive than the ADBAC or the EBC quat blends.

The same concept of synergistic combination in the EBC quats has been applied to the straight chain dialkyl quats. By mixing a dialkyl quat with an ADBAC quat in a 60/40 blend, a superior product was obtained as compared to the individual components. This new blend of quats represents the 5th generation of quaternary ammonium compounds.

The quaternary ammonium formulation of the present invention employs the 5th generation of quats, including at least one of n-Alkyl dimethyl benzyl ammonium chloride, n-Alkyl dimethyl ethylbenzyl ammonium chloride, octyl decyl dimethyl ammonium chloride, dioctyl dimethyl ammonium chloride, and didecyl dimethyl ammonium chloride. In the present invention, the n-Alkyl group of the n-Alkyl dimethyl benzyl ammonium chloride component of the quaternary ammonium formulation may range between $C_8$ and $C_{18}$. The n-Alkyl group of the n-Alkyl dimethyl ethylbenzyl ammonium chloride component of the quaternary ammonium formulation may range between $C_{12}$ and $C_{18}$.

The n-alkyl groups may consist of a mixture of long chain aliphatic hydrocarbon groups. A mixture of long chain aliphatic hydrocarbon groups may result, for example, in the preparation of various n-Alkyl dimethyl benzyl ammonium chlorides. The ingredients which are described herein are in a concentrated formulation and are intended to be diluted. Several embodiments of the present formulation can include an n-alkyl group which comprises about (40%) 40.5% to 43% $C_{12}$, about (50%) 47.5% to 52.5% $C_{14}$, about (10%) 8% to 12% $C_{16}$. In further embodiments, for example, the alkyl group may consist of about 67% $C_{12}$, about 25% $C_{14}$, about 7% $C_{16}$ and about 1% $C_{18}$, or about 40% $C_{12}$, about 50% $C_{14}$, and about 10% $C_{16}$, or about 5% $C_{12}$, about 60% $C_{14}$, about 30% $C_{16}$ and about 5% $C_{18}$, or about 14% $C_{12}$, about 58% $C_{14}$, and about 28% $C_{16}$.

Alternatively, the present invention may consist of, for example, a mixture of ABDAC and n-Alkyl dimethyl ethylbenzyl ammonium chloride, where the alkyl group of the ABDAC consists of about 5% $C_{12}$, about 60% $C_{14}$, about 30% $C_{16}$ and about 5% $C_{18}$, and the alkyl group of the n-Alkyl dimethyl ethylbenzyl ammonium chloride consists of about 50% $C_{12}$, about 30% $C_{14}$, about 17% $C_{16}$ and about 3% $C_{18}$, or the n-Alkyl dimethyl ethylbenzyl ammonium chloride may, alternatively, for instance, consist of about 68% $C_{12}$ and 32% $C_{14}$.

Another quaternary ammonium formulation of the present formulation comprises about 18–22% n-alkyl dimethyl benzyl ammonium chloride, about 14–17% octyl decyl dimethtyl ammonium chloride, about 5–10% dioctyl dimethyl ammonium chloride, and about 5–10% didecyl dimethyl ammonium chloride, with the rest being inert ingredients. The total amount of active quaternary ammonium chlorides found to be effective in the present formulation generally ranges from about 18.5 to 25%. Preferably the total amount of active quaternary ammonium chlorides is about 20 to 22 percent.

Chelating, sequestering or scale inhibiting ingredients are included in the formulation to neutralize the adverse consequences of having divalent and trivalent ions of calcium, magnesium, and iron and other less significant polyvalent metal cations in the washing solution. These divalent and trivalent cations enter the cleaning system with the water that is used as the main solvent in washing and rinsing and with the soils present in the system that are to be removed. These divalent and trivalent ions reduce the effectiveness of cleaning formulations. Subsequent reference to "hardness ions" refers to calcium, magnesium and, to a lesser degree, iron and other cations which are found in "hard water". Hardness ions can also precipitate fatty acids present in soils to prevent the solubilization and removal of the fatty acids by the surfactants. Inorganic anions such as carbonate, phosphate, silicate, sulfate, hydroxide and others can precipitate with hardness ions to form inorganic films, spots or deposits on hard surfaces and cleaning machines and devices. The hardness ions can also promote graying and discoloration of fabrics from the deposit of inorganic particles. We use the term sequestering to cover generally chelating and sequestering of polyvalent metal ions that interfere with the cleaning process when free in solution.

Additionally, the sequestering agents can tie up the halide ion to prevent formation of unwanted acid. Sequestering chemicals will prevent these adverse effects because they bind the hardness ions. Binding of the sequestering agent to the ions keeps the hardness ions in solution and prevents the hardness ions from precipitating with the aforementioned organic and inorganic anions. Therefore, addition of sequestering agents prevents mineral scale from building up on cleaning equipment, hard surfaces or fabrics being cleaned and promotes the rinsing of any residual hardness ion/sequestering agent complex that may have dried onto the substrate during the cleaning process.

In accordance with the invention, the sequestering agent is an organophosphonic acid selected from the group consisting of 1-hydroxyethylidene-1,1-diphosphonic acid; diethylenetriaminepenta(methylene phosphonic acid); amino tri (methylene phosphhonic acid) pentasodium salt; hexamethylene-diamine tetra (methylene phosphonic acid) hexapotassium salt; diethylenetriamine-penta (methylene phosphonic acid) penta sodium salt; N-hydroxyethyletylenediaminetriacetic acid; N-hydroxyethylethylenediaminetriacetic acid, trisodium salt, diethylenetriaminepentaacetic acid, pentasodium salt; dihydroxyethylglycine, sodium salt; calcium disodiumethylenediaminetetraaceticacid; and mixtures thereof. Dequest 2010, an organophosphonic acid sold by Solutia has been found to be particularly effective in the present invention. Preferably, the sequestering agent will be present in an active amount of about 3 to 6% by weight. A sequestering agent in the amount of 4.5% has been found to be effective. Ultimately, the sequestrant must be in sufficient amount to sequester said halide ion of the quaternary ammonium halide without eliminating the quaternary ammonium halide's sanitizing/disinfecting capability.

Other well known sequestering agents can be used in this invention, include sodium, potassium, and ammonium salts of orthophosphate or polyphosphates such as pyrophosphate, tripolyphosphate, trimetaphosphate, hexameta phosphate or other higher complex phosphates having up to 22 phosphorus atoms in the anion; Ethylenediaminetetraacetic (EDTA) acid or its fully or partially neutralized salts, e.g., sodium, potassium, ammonium or mono, di or triethanolamine salts; nitrilotriacetic acid (NTA) $N(CH_2CO_2H)3$ or its full or partially neutralized salts, e.g., sodium, potassium, ammonium or mono, di or triethanolamine salts; Other aminocarboxylic acids and their salts, for example: pentasodium diethylenetriamine pentaacetate, trisodium hydroxyethyl ethylenediamine triacetate, disodium ethanoldiglycine and sodium diethanolglycine; organic polycarboxylic acids and their salts such as oxalic acid, citric acid and gluconic acid; polyacrylic acid polymers and the sodium, potassium, ammonium or mono, di or triethanolamine salts from molecular weight 800 to 50,000; copolymers, of acrylic and maleic acid and the sodium, potassium, ammonium or mono, di or triethanolamine salts with molecular weights greater than 800; copolymers, of acrylic acid and itaconic acid and the sodium, potassium, ammonium or mono, di or triethanolamine salts with molecular weights between 800–50,000; copolymers of maleic acid and itaconic acid and the sodium, potassium, ammonium or mono, di or triethanolamine salts with molecular weights between 800–50,000; amino trimethylene phosphonic acid and its sodium, potassium, ammonium or mono, di or triethanolamine salts; 1-hydroxyethylidine-1,1-diphosphonic acid and its sodium, potassium, ammonium or mono, di or triethanolamine salts; hexamethylenediamine tetra(methylenephosphonic acid) and its sodium, potassium, ammonium or mono, di or triethanolamine salts; diethylene triamine penta(methylenephosphonic acid) and its sodium, potassium, ammonium or mono, di or triethanolamine salts.

An alkanolanine, such as triethanolamine, diethanolamine, monoethanolamine or a mixture thereof is used as the solvent in the present invention in an amount of about 20 to 30% by weight. Preferably, the alkanolamine is triethanolamine. Triethanolamine in an amount of about 24% by weight has been found to be particularly effective. Other suitable alkanolamines may be used including, but not limited to, polyoxyethylene tallowamine, and polyoxyethylene oleylamine.

An additional component utilized in the disinfectant cleaning formulation of the present invention is a surfactant. The use of surfactants is to assist in decreasing the surface tension of water and remove soils from the substrate. A particularly desirable group of surfactants are those that maintain the stability of the cationic disinfectant and the microbiological materials. The surfactants that are preferably utilized are non-ionic and amphoteric materials. These materials provide efficient wetting of the substrate to be cleaned, emulsification of oily soils and are tonically compatible with the cationic components of the cleaning formulation.

Preferably, the surfactant useful in the present invention is an ethoxylated long chain alcohol selected from the group consisting of polyoxyethylene (6) linear $C_{10}$–$C_{12}$ Alcohol, polyoxyethylene (9) linear $C_{12}$–$C_{14}$ Alcohol, polyoxyethylene (12) linear $C_{12}$–$C_{14}$ Alcohol, and mixtures thereof. Other surfactants, e.g., non-ionic, cationic, or amphoteric materials that may be utilized including fatty amines (primary, secondary, or tertiary, as well as derivatives) or oxides, alkanolamides (and derivatives, including fatty alkanolamides), glycerides (including mono, di, tri, etho, etc.), esters (including mono, di, tri, etho, etc.), alkyl polyglucosides, linear primary alcohols ($C_9$–$C_{15}$ alkyl range), amine oxides, and ethoxylates (including linear alcohol, secondary, branched, decyl phenol, etc.).

Further examples of non-ionic surfactants are materials known as Surfonic linear alcohol ethoxylates, -series nonylphenol ethoxylates (trademark of Huntsman) Igepal (trademark of Rhodia, Inc. for nonyl phenoxy polyethoxy ethanol); Tergitol NP (trademark of Union Carbide Corp. for nonylphenol ethoxylate); Tergitol 15-S (trademark of Union Carbide Corp. for secondary alcohol ethoxylates); Triton X series (trademark of Union Carbide Corp. for octyl phenol polyethoxylate) and Tween Materials (trademark of ICI Americas, Inc. for polyoxyethylene (20) sorbitan monostearate and polyoxyethylene sorbitan monooleate). Examples of amphoteric materials include Mirataine CBC and Miranol C2MSF (trademark of Rhodia, Inc. for surfactant) and Lexaine (trademark of Inolex Co. for cocoamidopropyl betaine). Examples of an amine oxide include Macat AO-12 (trademark of Mason Chemical Company) and "gemini" surfactants which are generally defined as bis-surfactants which contain at least two structures, each having a hydrophobic chain and an ionic or polar group. The structures are connected by a spacer which may be flexible or rigid and is polar or nonpolar. A specific example of a "gemini" surfactant would be $C_{12}H_{25}N+(CH_3)_2—CH_2—C_6H_4—CH_2—N+(CH_3)_2C_{12}H_{25}$.

In the present formulation the surfactant is present in an amount of about 3 to 9% by weight, and which is preferably polyoxyethylene (6) $C_{10}$–$C_{12}$ Alkyl, preferably present in an amount of about 6% by weight. The purpose is to have enough surfactant present to perform as a surfactant without substantially inhibiting the sanitizing/disinfecting properties of the quat. Other suitable linear alcohol ethoxylates such as polyoxyethylene (9.5) nonylphenol, polyoxyethylene (10) nonylphenol, polyoxyethylene (10.2) nonylphenol, etc. may be employed in the present invention.

Typically water is used as a diluent in the amount about 5 to 50%. Preferably the amount of water present is about 20 to 45%. Other suitable diluents may be used. It should be understood that one agent may be used for multiple purposes. For instance, one agent may act as a sequestrant, solvent and diluent. It is not necessary to have an individual chemical for each function. For example, TEA may be used for multiple purposes including a sequestering agent and as a solvent.

A particularly efficient method of employing the formulation of the present invention is to prepare a concentrated solution having a composition of about 18.5 to 25%, preferably, about 20 to 22% quaternary ammonium chloride; about 20 to 30%, preferably, about 22 to 26% solvent; about 3 to 6%, preferably, about 4 to 5% sequestrant; about 3 to 9%, preferably, about 5 to 7% surfactant; and about 18 to 26, preferably, about 20 to 24% diluent. The concentrated solution is then conveniently diluted to a more usable concentration before using. Before using in accordance with the invention, the concentrated solution is preferably diluted with water in a ratio of concentrate to water to provide the diluted solution which will have a composition containing about 0.014 to 0.35%, preferably about 0.015 to 0.342% by weight quaternary ammonium chloride; about 0.002 to 0.9%, preferably about 0.00243 to 0.08292% by weight sequestrant; about 0.016 to 0.45%, preferably about 0.162 to 0.41% by weight solvent; and about 0.002 to 0.1 5%, preferably about 0.00243 to 0.12483% by weight surfactant.

EXAMPLE 1

A 100 pound batch of concentrated formulation was made using the following ingredients:

43.4 lbs.—of a quaternary ammonium chloride containing a mixture of an n-alkyl dimethyl benzyl ammonium chloride, an octyl decyl dimethyl ammonium chloride, a dioctyl dimethyl ammonium chloride, and a didecyl dimethyl ammonium chloride;

4.5 lbs—Dequest 2010, 24.0 lbs—triethanolamine 6.0 lbs—Surfonic L12-6, and 22.1 lbs—municipal water were mixed and stirred until completely blended.

The ingredients were mixed and stirred until they were completely blended. The blend exhibited a light clear amber color. The blend was then diluted 1:108 with water to provide a useful formulation (2000 ppm quat or 0.926%). The diluted formulation exhibited a white cloudy emulsion and had a pH of between 6 and 9. The flash rusting characteristics of the diluted formulation was evaluated by placing a pad of steel wool in a portion of the formulation. After 24 hours only slight amounts (two small spots on pad) of rust started to form and after 48 hours, the two spots were less than 0.25 inches. Finally, after 62 hours, no further rust had formed. The test was discontinued after 62 hours due to evaporation.

EXAMPLE 2

Also performed was the Citrus Canker Rust Test II, which involved the spraying of a portion of the diluted solution of Example 1 onto a bare metal surface using a trigger spray bottle. The metal surface received three sprays every hour. The metal surface remained wet for 2–5 minutes after each application. After 9 applications, the panel was clean and clear with no rust build up. A slight protective film was formed. After 12 applications, the metal panel was pretty much rust free.

EXAMPLE 3

A 100 pound batch was made using the following ingredients:

43.4 lbs.—Of a quaternary ammonium chloride containing a mixture of n-alkyl dimethyl benzyl ammonium chloride, octyl decyl dimethyl ammonium chloride, dioctyl dimethyl ammonium chloride, and didecyl dimethyl ammonium chloride 1.5 lbs.—Sodium meta silicate;

8.0 lbs.—EDTA;

6.0 lbs.—Surfonic L12-6; and 41.1 lbs.—municipal water were mixed and stirred until completely blended.

The ingredients were mixed and stirred until they were completely blended. The concentrated blend exhibited a clear amber color and had a pH of between 6 and 9. The blend was then diluted 1:108 with water to provide a useful formulation (2000 ppm quat or 0.926%). The diluted formulation exhibited a white cloudy emulsion and had a pH of between 11 and 12. The flash rusting characteristics of the diluted formulation was evaluated by placing a pad of steel wool in a portion of the diluted formulation. After one hour, some rust was beginning to appear. After 24 hours, heavy rust was evident in the water and on the pad and rust had precipitated out on the bottom of the bowl. After 48 hours, severe rust precipitated onto the bottom of the bowl and the pad was covered with rust. The test was discontinued after 62 hours due to evaporation.

EXAMPLE 4

The Citrus Canker Rust Test 11 was performed , wherein a portion of the diluted formulation of Example 3 was sprayed onto a bare metal surface using a trigger spray bottle. The metal surface received three sprays every hour. The metal surface remained wet for 2–5 minutes after each application. Very, very slight spots started to appear after 6 applications. Otherwise, the panel was clean and clear. After 9 applications, the rust spots started getting larger in the middle of the spray application. There appeared to be a slight film build up. There was not much change from the ninth application. A little more rust started to develop.

EXAMPLE 5

A 100 pound batch was made using the following ingredients:

43.4 —lbs. of a quaternary ammonium chloride containing a mixture of—alkyl dimethyl benzyl ammonium chloride, octyl decyl dimethyl ammonium chloride, dioctyl dimethyl ammonium chloride, and didecyl dimethyl ammonium chloride;

4.5 —lbs. Dequest 2010, 8.0 —lbs. triethanolamine 6.0 —lbs. Surfonic L12-6, and 38.2 —lbs. municipal water.

The ingredients were mixed and stirred until they were completely blended. The concentrated blend was then diluted 1:108 with water to provide a useful formulation (2000 ppm quat or 0.926%). The diluted formulation exhibited a cloudy emulsion and had a pH of between 6 and 9. The flash rusting characteristics of the diluted formulation was evaluated by placing a pad of steel wool in a portion of the formulation. After 1 hour, slight rust formation was noticed. Rust continued to form until 62 hours when it appeared that the rust had come to an equilibrium in the solution. Rust spots on the pad continued to get larger. The test was discontinued after 62 hours.

EXAMPLE 6

Citrus Canker Rust Test 11 was performed , wherein a portion of the diluted formulation of Example 5 was sprayed onto the surface of a metal panel using a trigger spray bottle. The metal surface received three sprays every hour. The surface of the metal panel remained wet for 2–5 minutes after each application. Rust spots started to develop after only 6 applications. Also a film started to form. After 9 applications, the panel showed heavy rust and film build up. After 12 applications, heavy rust continued to form.

EXAMPLE 7

A 100 pound batch was made using the following ingredients:

43.4 —lbs. of a quaternary ammonium chloride containing a mixture of—alkyl dimethyl benzyl ammonium chloride, and n-alkyl dimethyl ethylbenzyl ammonium chloride.

1.5 —lbs. Dequest 2010, 8.0 —lbs. triethanolamine 6.0 —lbs. Surfonic L12-6, and 41.1 —lbs. municipal water were mixed and stirred until completely blended.

The ingredients were mixed and stirred until they were completely blended. The blend was then diluted 1:108 with water to provide a useful formulation (2000 ppm quat or 0.926%). The diluted formulation exhibited a slightly cloudy emulsion and had a pH of between 6 and 9. Flash rusting characteristics of the diluted formulation was evaluated by placing a pad of steel wool in a portion of the diluted formulation. Some rust started to appear after 1 hour. Rust continued to form after 4 hours, but not bad. After 24 hours, rust developed all around and started appearing on the pad. At 48 hours rust was spreading through the pad. Rust in the bowl was precipitating out in what appeared to be striations. After 62 hours, the test was discontinued due to evaporation.

EXAMPLE 8

The Citrus Canker Rust Test 11 was performed , wherein a portion of the diluted formulation of Example 7 was sprayed onto the surface of a metal panel using a trigger spray bottle. The metal surface received three sprays every hour. The surface of the metal panel remained wet for 2–5 minutes after each application. Rust spots started to develop after 6 applications and there was some film build up. More rust and film build up appeared after 9 applications. Additional rust and film build up occurred after 12 applications.

EXAMPLE 9

A 100 pound batch was made using the following ingredients:

43.4 —lbs. of a quaternary ammonium chloride containing a mixture of—alkyl dimethyl benzyl ammonium chloride, and n-alkyl dimethyl ethylbenzyl ammonium chloride.

4.5 —lbs. Dequest 2010, 8.0 —lbs. triethanolamine 6.0 —lbs. Surfonic L12-6, and 38.2 —lbs. municipal water.

The ingredients were mixed and stirred until they were completely blended. The blend was then diluted 1:108 with water to provide a useful formulation (850 ppm quat or 0.085%). The diluted formulation exhibited a slightly cloudy emulsion and had a pH of between 6 and 9. Flash rusting characteristics of the diluted formulation was evaluated by placing a pad of steel wool in a portion of the diluted formulation. Slight rusting started to appear after 1 hour. Rust continued to form and after 24 hours, rust had form all around the pad with slight precipitation of rust. Rust continued to form until the test was discontinued at 48 hours.

Having described the invention in detail, it will be apparent that modifications and variations are possible without departing from the scope of the invention defined in the appended claims.

What is claimed is:

1. A corrosion inhibiting, sanitizing/disinfectant, wood preserving, and hard surface cleaning concentrate formulation capable of being diluted consisting essentially of:

about 18.5 to 25% of a mixture of at least two selected from the group of alkyl dimethyl benzyl ammonium chloride, octyl decyl dimethyl ammonium chloride, dioctyl dimethyl ammonium chloride and didecyl dimethyl ammonium chloride;

about 3 to 6% of a sequestrant selected from the group consisting of 1-hydroxyethylidene-1,1-diphosphonic acid; diethylenetriaminepenta (methylene phosphonic acid); amino tri-(methylene phosphonic acid) pentasodium salt; 1-hydroxy-ethylidene-1,1-diphosphonic acid, tetrasodium salt; hexamethylene-diamine tetra (methylene phosphonic acid), hexapotassium salt; diethylenetriamine-penta (methylene phosphonic acid), penta sodium salt; N-hydroxyethylenediaminetriacetic acid; N-hydroxyethylenediaminetriacetic acid, trisodium salt; diethylenetriaminepentaacetic acid, pentasodium salt; dihydroxyethylglycine, sodium salt; and calcium disodiumethylenediaminetetraacetic acid;

about 20 to 30% of an alkanol solvent selected from the group consisting of triethanolamine, diethanolamine, ethanolamine, and mixtures thereof;

about 3 to 9% of an ethoxylated long chain alcohol surfactant selected from the group consisting of polyoxyethylene (6) linear $C_{10}$–$C_{12}$ alcohol, polyoxyethylene (9) linear $C_{12}$–$C_{14}$ alcohol, polyoxyethylene (12) linear $C_{12}$–$C_{14}$ alcohol, mixtures thereof; and the remainder water, said formulation having a pH of about 6 to 9.

2. The formulation of claim 1, wherein said quaternary ammonium halide mixture includes about 18.5 to 22% by weight n-alkyl dimethyl benzyl ammonium chloride, about 14 to 17% by weight octyl decyl dimethyl ammonium chloride, about 5 to 10% by weight dioctyl dimethyl ammonium chloride and about 5 to 10% by weight didecyl dimethyl ammonium chlorid, with the balance inert ingredients.

3. The formulation of claim 1, wherein said alkyl dimethyl benzyl ammonium chloride is a mixture of $C_8$ to $C_{18}$ alkyl dimethyl benzyl ammonium chlorides.

4. The formulation of claim 3 wherein said mixture of $C_8$ to $C_{18}$ alkyl dimethyl benzyl ammonium chlorides includes about 5 to 70% $C_{12}$ alkyl dimethyl benzyl ammonium chloride, about 25 to 60% $C_{14}$ alkyl dimethyl benzyl ammonium chloride, about 7 to 30% $C_{16}$ alkyl dimethyl benzyl ammonium chloride and about 1 to 5% $C_{18}$ alkyl dimethyl benzyl ammonium chloride.

5. The formulation of claim 1, wherein said mixture further includes $C_{12}$ to $C_{18}$ alkyl dimethyl ethylbenzyl ammonium chlorides.

6. The formulation of claim 5 wherein said mixture of $C_8$ to $C_{18}$ alkyl dimethyl ethylbenzyl ammonium chlorides includes about 50 to 70% $C_{12}$ alkyl dimethyl ethylbenzyl ammonium chloride, about 30 to 35% $C_{14}$ alkyl dimethyl ethylbenzyl ammonium chloride, about 1 to 20% $C_{16}$ alkyl dimethyl ethylbenzyl ammonium chloride and about 1 to 5% $C_{18}$ alkyl dimethyl ethylbenzyl ammonium chloride.

7. The formulation of claim 1, wherein said formulation further includes a diluent to thereby form a diluted formulation wherein said mixture, said sequestrant, said solvent, and said surfactant are diluted proportionally by said diluent.

8. The formulation of claim 7, wherein said mixture of quaternary ammonium chlorides is present in an amount of about 0.014 to 0.35% by weight after being diluted.

9. The formulation of claim 8, wherein said mixture is present an amount of about 0.015 to 0.342% by weight after being diluted.

10. The formulation of claim 7, wherein said quaternary ammonium chloride mixture contains about 0.0054 to 0.129% by weight alkyl dimethyl benzyl ammonium chloride, about 0.0048 to 0.099% by weight octyl decyl dimethyl ammonium chloride, about 0.0019 to 0.057% by weight dioctyl dimethyl ammonium chloride, and about 0.0019 to 0.057% by weight didecyl dimethyl ammonium chloride.

11. The formulation of claim 7, wherein said sequestrant is 1-hydroxyethylidene-1,1-diphosphonic acid present in an amount of about 0.002 to 0.09% by weight after being diluted.

12. The formulation of claim 11, wherein said 1-hydroxyethylidene-1,1-diphosphonic acid is present in an amount of about 0.00243 to 00.08292% by weight after being diluted.

13. The formulation of claim 7, wherein said solvent is triethanolamine present in an amount of about 0.016 to 0.45% by weight after being diluted.

14. The formulation of claim 13, wherein said solvent is present in an amount of about 0.162 to 0.41% by weight after being diluted.

15. The formulation of claim 7, wherein said surfactant is polyoxyethylene (6) linear $C_{10}$–$C_{12}$ alcohol present in an amount of about 0.002 to 0.15% by weight after being diluted.

16. The formulation of claim 15, wherein said surfactant is present in an amount of about 0.00243 to 0.12483% by weight after being diluted.

17. The formulation of claim 7, wherein said diluent is water present in an amount of about 99.93% by weight.

18. The formulation of claim 7, wherein said formulation is diluted to include:

about 0.014 to 0.35% of said mixture of quaternary ammonium halides;

about 0.002 to 0.09% of said sequestrant, said sequestrant being an organophosphonic acid selected from the group consisting of 1-hydroxyethylidene-1,1-diphosphonic acid; diethylenetriaminepenta (methylene phosphonic acid); amino tri-(methylene phosphonic acid) pentasodium salt; 1-hydroxyethylidene-1,1-diphosphonic acid, tetrasodium salt; hexamethylene-diamine tetra (methylene phosphonic acid) hexapotassium salt; diethylenetriamine-penta (methylene phosphonic acid) penta sodium salt and mixtures thereof;

about 0.0162 to 0.41% of said solvent, said solvent being triethanolamine;

about 0.00243 to 0.012483% of said surfactant, said surfactant being polyoxyethylene (6) $C_{10}$–$C_{12}$ alcohol; and the remainder water, said formulation having a pH of about 6 to 9.

19. The formulation of claim 7, wherein said formulation is diluted to include:

about 0.015 to 0.342% of said mixture of quaternary ammonium halides;

about 0.00243 to 0.08292% of said organphosphonic acid, wherein said organphosphonic acid is 1-hydroxyethylidene-1,1-diphosphonic acid;

about 0.0162 to 0.41% of said solvent, wherein said solvent is triethanolamine;

about 0.00243 to 0.012483% of said surfactant, wherein said surfactant is polyoxyethylene (6) $C_{10}$–$C_{12}$ alcohol; and the remainder water, said formulation having a pH of about 6 to 9.

20. The formulation of claim 18, wherein said mixture of alkyl dimethyl benzyl ammonium chloride, octyl decyl dimethyl ammonium chloride, dioctyl dimethyl ammonium chloride, and didecyl dimethyl ammonium chloride includes about 0.0064 to 0.129% by weight n-alkyl dimethyl benzyl ammonium chloride, about 0.0048 to 0.099% by weight octyl decyl dimethyl ammonium chloride, about 0.0019 to 0.057% by weight dioctyl dimethyl ammonium chloride, and about 0.0019 to 0.057% by weight didecyl dimethyl ammonium chloride.

21. A corrosion inhibiting, sanitizing/disinfectant, wood preserving, and hard surface cleaning concentrate formulation capable of being diluted consisting essentially of:

about 18.5 to 25% of a mixture containing at least two selected from the group of alkyl dimethyl benzyl ammonium chloride present in an amount of about 18 to 22% by weight, octyl decyl dimethyl ammonium chloride present in an amount of about 14 to 17% by weight, dioctyl dimethyl ammonium chloride present in an amount of about 5 to 10% by weight and didecyl dimethyl ammonium chloride present in amount of about 5 to 10% by weight, with the balance inert ingredients;

about 3 to 6% 1-hydroxyethylidene-1,1-diphosphonic acid;

about 20 to 30% triethanolamine;

about 3 to 9% polyoxyethylene (6) linear $C_{10}$–$C_{12}$ alcohol; and the remainder water, said formulation having a pH of about 6 to 9.

* * * * *